US009174261B2

(12) United States Patent
Matsuda et al.

(10) Patent No.: US 9,174,261 B2
(45) Date of Patent: Nov. 3, 2015

(54) PRESS WORKING APPARATUS

(75) Inventors: Toshifumi Matsuda, Tochigi (JP); Kohei Teshima, Tochigi (JP); Kazuya Saito, Tochigi (JP); Jiro Watanabe, Tochigi (JP); Hiroyuki Eguchi, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 587 days.

(21) Appl. No.: 13/421,225

(22) Filed: Mar. 15, 2012

(65) Prior Publication Data

US 2012/0255337 A1 Oct. 11, 2012

(30) Foreign Application Priority Data

Apr. 7, 2011 (JP) ..... 2011-085199

(51) Int. Cl.
*B21D 24/04* (2006.01)
*B21D 22/22* (2006.01)

(52) U.S. Cl.
CPC ..... *B21D 24/04* (2013.01); *B21D 22/22* (2013.01)

(58) Field of Classification Search
CPC ..... B21D 22/22; B21D 24/04
USPC ..... 72/75, 308, 324, 355.4, 396, 441, 72/452.1–452.7, 453.01, 453.09, 72/453.12–453.15
See application file for complete search history.

(56) References Cited

U.S. PATENT DOCUMENTS 3,427,856 A * 2/1969 Asari ..... 72/453.13
4,089,204 A * 5/1978 Neilsen ..... 72/452.6

FOREIGN PATENT DOCUMENTS

CN 101862787 10/2010
JP 2005-138111 6/2005

OTHER PUBLICATIONS

English translation of Chinese Office Action dated Dec. 4, 2013 (5 pages).

* cited by examiner

*Primary Examiner* — Teresa M Ekiert
(74) *Attorney, Agent, or Firm* — Rankin, Hill & Clark LLP

(57) ABSTRACT

A press working apparatus for processing a heated workpiece is provided with a base part which is relatively movable so as to advance and retreat with respect to the workpiece, a pad provided on the base part and configured to hold the workpiece, a working tool provided on the base part to pass through the pad and adapted to process the workpiece, and a support member configured to movably support the working tool in a direction perpendicular to an advance and retreat direction of the base part.

3 Claims, 8 Drawing Sheets

PRESS WORKING APPARATUS

BACKGROUND OF THE INVENTION

1. Field of the Invention

The present invention relates to a press working apparatus for processing a heated workpiece.

2. Related Art

Conventionally, a press working method in which a heated workpiece is press-worked and then subjected to a quenching process is known. Since a processed product obtained by such a working method has a high strength owing to the quenching process, it is difficult to perform a punching process or a cutting process by a working tool. The punching process or the cutting process of the processed product can be performed by a laser processing. However, in this case, there is a problem that a manufacturing cost is raised, as compared to a case of utilizing the working tool.

JP-A-2005-138111 discloses a working method in which a heated workpiece is press-worked by a pad (punch) and at the same time is punched by a working tool (movable mold) passing through the pad, and then a quenching process is completed. According to this working method, the workpiece can be subjected to a punching process before it has a high strength by the quenching process. Accordingly, it is possible to easily perform the punching process for the workpiece.

However, according to the working method of JP-A-2005-138111, the heated workpiece is press-worked and therefore the pad is thermally expanded due to a heat of the workpiece during the press working. In the meantime, the working tool is caused to perform the punching process for the workpiece and thus just temporarily contacts the workpiece. Accordingly, the amount of thermal expansion of the working tool is small, as compared to the pad. For this reason, a positional relationship between a through hole provided in the pad and the working tool is deviated and thus there is a possibility that the working tool and the pad are interfered with each other. Consequently, there is a risk that a cutting blade of the working tool is worn and thus the processing precision is degraded or the press working cannot be performed due to the damage of the pad.

SUMMARY OF THE INVENTION

One or more embodiments relates to a press working apparatus capable of avoiding the interference between a working tool and a pad so that a workpiece can be securely processed by the working tool with high precision.

DETAILED DESCRIPTION OF THE EMBODIMENTS

Hereinafter, a press working apparatus according to an embodiment will be described in detail with reference to accompanying drawings. The embodiment and its modifications described herein are not intended to limit the invention but only to exemplify the invention, and all features or combinations of the features of the embodiment and its modifications are not always essential to the invention.

In the press working apparatus 10 of the present embodiment, a metal plate W (workpiece) is subjected to a first press working and then a further (second) press working (punching processing, piercing processing), and then is cooled to a predetermined temperature. Meanwhile, hereinafter, the workpiece W subjected to a first press working is referred to a first processed workpiece W1 and the workpiece W subjected to a second press working is referred to a second processed workpiece W2.

Figure 1:
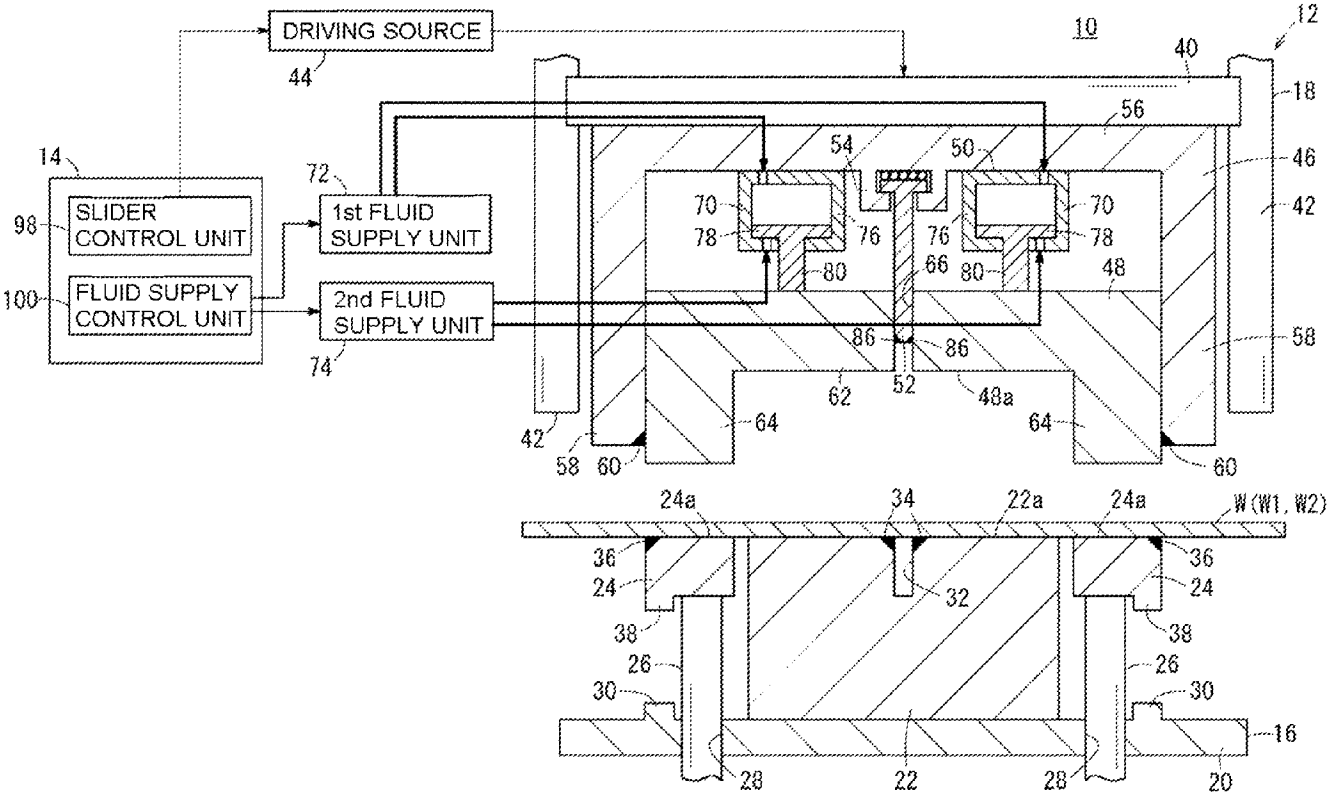
FIG. 1 is a sectional view for explaining a press working apparatus according to one embodiment of the present invention.

As illustrated in FIG. 1, the press working apparatus 10 includes an apparatus main body 12 for processing the workpiece W (first processed workpiece W1) and a control unit 14 for controlling the apparatus main body 12.

The apparatus main body 12 includes a lower mold (first mold) 16 and an upper mold (second mold) 18 which is arranged over the lower mold 16. The lower mold 16 have a fixed base 20 as a base, a male punching part 22 provided on the fixed base 20, an annular blank holder 24 arranged outside the punching part 22 and supporting apart of the workpiece W, and a plurality (two pins are illustrated in drawings) of pins 26, 26 fixed to the blank holder 24.

The fixed base 20 is provided with a plurality of through holes 28, 28 through which the plurality of pins 26, 26 are inserted. Further, a region of the fixed base 20 opposed to the blank holder 24 is provided with a pair of protrusions 30, 30.

The punching part 22 performs a press working for the workpiece W while holding the workpiece W together with a die part 48 (which will be described later) constituting the upper mold 18. The punching part 22 is provided at its outer surface with a punching surface 22*a* which is adapted to contact a lower surface of the workpiece W. The punching surface 22*a* is formed with a relief hole 32 through which a working tool 52 (which will be described later) can be inserted. The relief hole 32 is provided at its edge with a cutting blade 34.

The plurality of pins 26, 26 fixed to the blank holder 24 are connected to a moving mechanism (not illustrated) and the blank holder 24 is raised or lowered in vertical direction by the action of the moving mechanism. The blank holder 24 has a placing surface 24*a* on which the workpiece W is placed. The placing surface 24*a* is provided at its outer edge with a cutting blade 36. A lower surface of the blank holder 24 is provided with a pair of stoppers 38, 38 which are adapted to contact the protrusions 30, 30 mentioned above.

The upper mold 18 includes a slider 40, a pair of rails 42, 42 for guiding the slider 40 in a vertical direction, a driving source 44 for driving the slider 40, a base part 46 provided on the slider 40, a female die part (pad) 48 supported on the base part 46 via a cylinder mechanism (biasing mechanism) 50, a working tool 52 for punching the workpiece Wand a support member 54 provided on the base part 46 to support the working tool 52.

Figure 7:
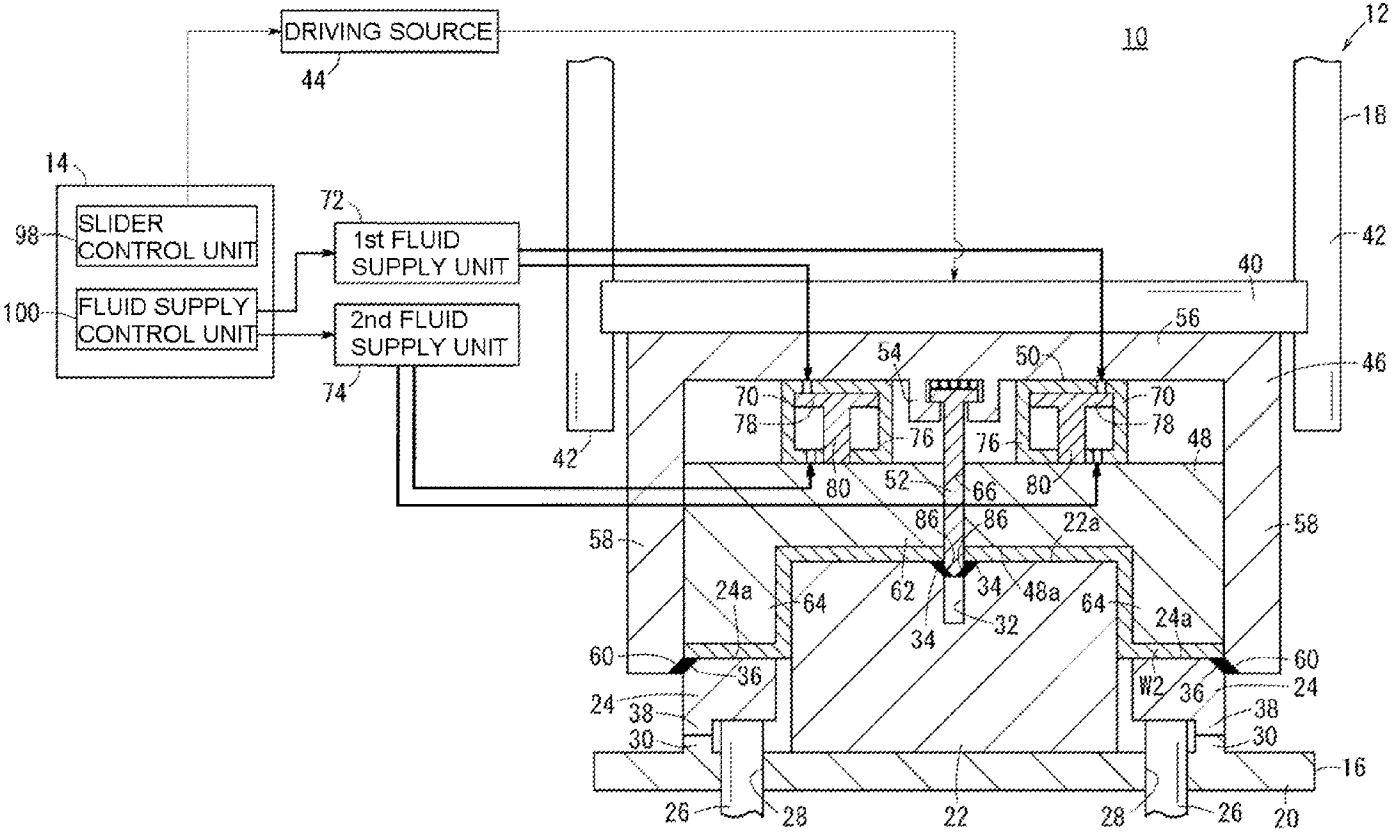
FIG. 7 is a sectional view for explaining the press working apparatus in a state where a second press working is performed.
Figure 8:
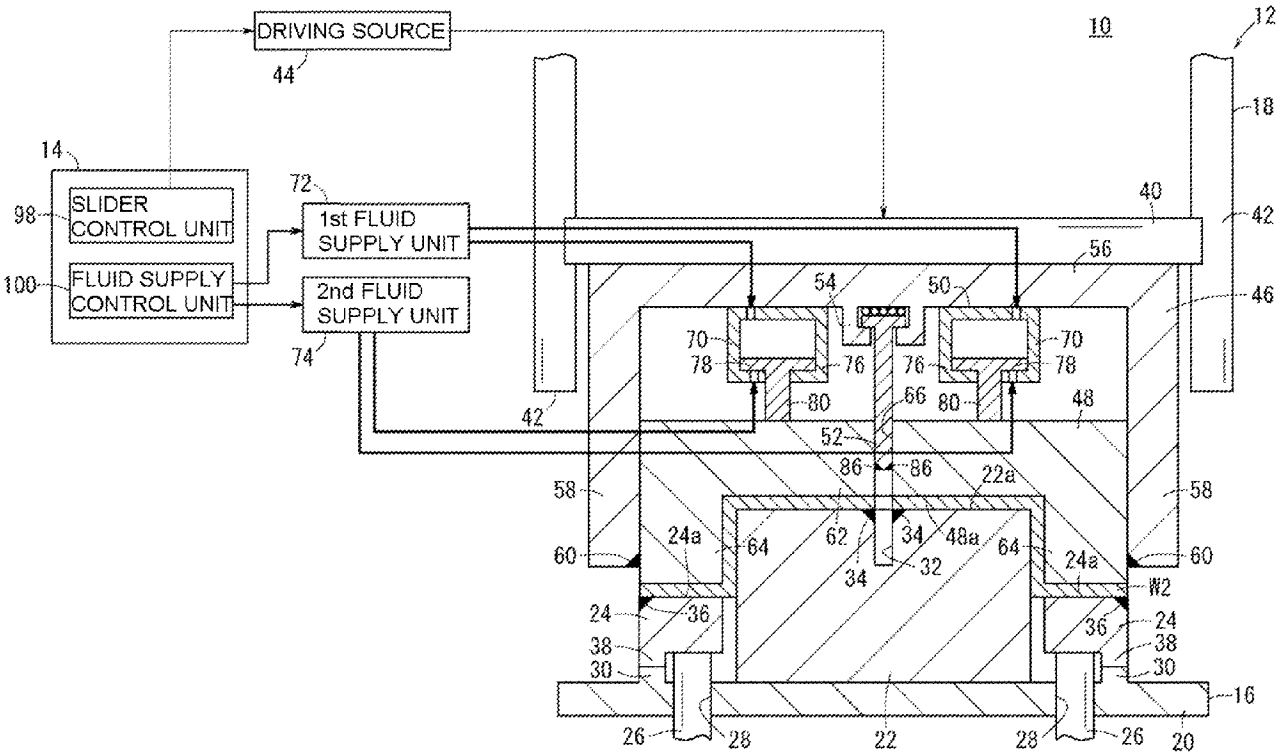
FIG. 8 is a sectional view for explaining the press working apparatus in a state where a working tool is retreated from a second processed workpiece.

The base part 46 includes a plate-like fixed portion 56 fixed to the lower surface of the slider 40 and a cylindrical extending portion 58 extending downward from an edge of the fixed portion 56. The lower end surface of the extending portion 58 is provided at its inner edge with a cutting blade 60. Unnecessary portions of the workpiece W are cut away by the cutting blade 60 and the above cutting blade 36 provided on the blank holder 24 (see FIG. 7).

The die part 48 is accommodated in a space inside the extending portion 58. Thereby, the press working apparatus 10 can be formed in more compact manner, as compared to a case where the die part 48 is arranged at a region other than the space. The die part 48 performs a press working for the workpiece W while holding the workpiece W together with the punching part 22 constituting the lower mold 16. The die part 48 includes a thick die main body 62 formed in the form of a plate and an annular holder portion 64 projecting downward from an edge of the die main body 62. The die main body 62 is formed with a through hole 66 through which the working tool 52 passes. The lower surface of the die main body 62 is terminated at an inner surface of the holder portion 64. And, a punching surface 48*a* adapted to contact an upper surface of the workpiece W is formed by the lower surface of the die main body 62 and the inner surface of the holder portion 64. This punching surface 48*a* is formed in a shape corresponding to the shape of the punching surface 22*a*.

When the workpiece W is press-worked, the holder portion 64 holds the workpiece W together with the blank holder 24 to prevent a wrinkle or a positional offset from occurring. Accordingly, a lower end surface of the holder portion 64 is adapted to contact the workpiece W ahead of the punching surface 48*a*. Meanwhile, an outer surface of the holder portion 64 is in sliding contact with the inner surface of the extending portion 58. Thereby, when the base part 46 and the die part 48 are moved relative to each other, the shaking of the extending portion 58 can be suitably prevented. Accordingly, it is possible to improve the cutting precision of the cutting blade 60 of the extending portion 58 for the first processed workpiece W.

The cylinder mechanism 50 includes a pair of cylinder units 70, 70, and a first fluid supply unit 72 and a second fluid supply unit 74 for supplying a fluid to respective cylinder unit 70.

For example, each of the cylinder units 70 is configured as a hydraulic cylinder and includes a cylinder main body 76 fixed to the lower surface of the fixed portion 56, a piston 78 accommodated in the cylinder main body 76 to move in a vertical direction, and a rod portion 80 integrally formed with the piston 78 and fixed to an upper surface of the die main body 62.

The first fluid supply unit 72 supplies a fluid in the cylinder main body 76 of each cylinder unit 70 to bias the piston 78 downward. Meanwhile, the second fluid supply unit 74 supplies a fluid in the cylinder main body 76 of each cylinder unit 70 to bias the piston 78 upward.

Figure 2:
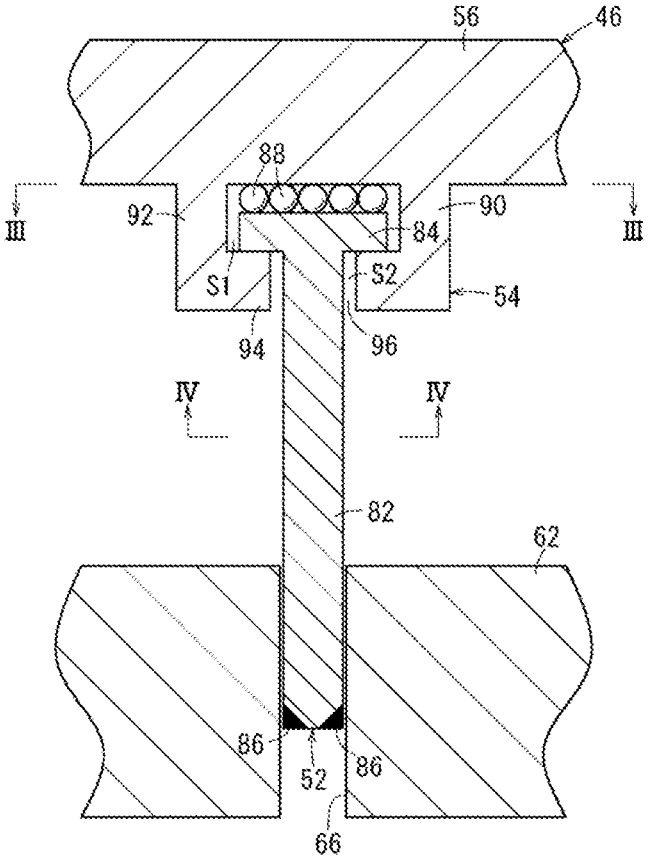
FIG. 2 is an enlarged sectional view illustrating a working tool illustrated in FIG. 1 and its surrounding region.
Figure 3:
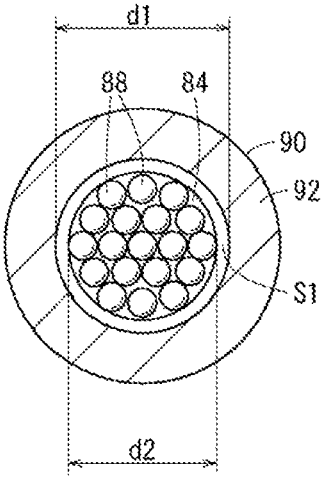
FIG. 3 is a sectional view taken along line III-III of FIG. 2.

As illustrated in FIG. 2, for example, the working tool 52 is made from a tool steel and includes a columnar tool main body 82 extending in a vertical direction and a disk-shaped flange part 84 integrally provided on a rear end of the tool main body 82 (see FIG. 3). The length of the tool main body 82 is set longer than the thickness of the die main body 62. The lower end surface of the tool main body 82 is provided at its edge with a cutting blade 86. A punching process can be performed by the cutting blade 86 and the cutting blade 34 provided on the punching part 22 (see FIG. 7).

The support member 54 includes a plurality of rolling elements 88 . . . 88 provided between the upper surface of the flange part 84 (rear end surface of the working tool 52) and the lower surface of the fixed portion 56 and a housing 90 accommodating the plurality of rolling elements 88 . . . 88 and the flange part 84. Each rolling element 88 is formed in a spherical shape and therefore can be freely rolled in a direction (horizontal direction) perpendicular to a moving direction of the slider 40. Further, each rolling element 88 is made from a material with good load bearing, such as steel (high carbon chromium steel or stainless steel). By doing so, it is possible to prevent the deformation of the rolling element 88 due to a load applied by the working tool 52 when the punching process is performed.

The housing 90 includes a cylindrical part 92 extending downward from the lower surface of the fixed portion 56 and a collar part 94 extending inward from a lower end of the cylindrical part 92 to contact the lower surface of the flange part 84.

The inner diameter d1 of the cylindrical part 92 is set larger than the outer diameter d2 of the flange part 84 (see FIG. 3). That is, a suitable clearance S1 is provided between the cylindrical part 92 and the flange part 84. The difference (d1−d2: first diameter difference) between the inner diameter d1 and the outer diameter d2 is set smaller than a diameter of the rolling element 88, preferably smaller than a radius of the rolling element. Thereby, it is possible to suitably prevent the rolling element 88 from being fitted into the clearance S. Herein, for the purpose of easy understanding, FIGS. 2 to 4 exaggeratedly illustrate the clearance S and a clearance S2 (which will be described below).

Herein, the first diameter difference can be arbitrarily set. In particular, when a stopper (not illustrated) is, for example, provided at a peripheral edge of the upper surface of the flange part 84 for preventing the rolling element 88 from moving toward the clearance S1, the rolling element 88 can be prevented from being fitted into the clearance S1 even if the first diameter difference is set larger than the diameter of the rolling element 88. Further, as the clearance S is set larger, there is no case that a lubricant is entered into the clearance S1 to block the clearance S1 even if a lubricant (grease) is applied on the plurality of rolling elements 88 . . . 88.

Figure 4:
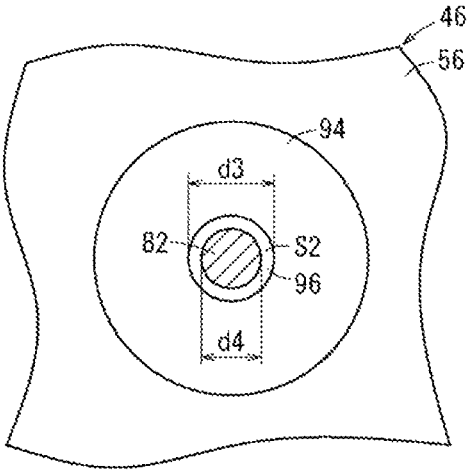
FIG. 4 is a sectional view taken along line IV-IV of FIG. 2.

As illustrated in FIG. 4, the collar part 94 is formed in a ring shape. Thereby, a central portion of the collar part 94 is provided with an opening 96 through which the tool main body 82 is inserted. The diameter d3 of the opening 96 is set larger than an outer diameter d4 of the tool main body 82. That is, a suitable clearance S2 is provided between the tool main body 82 and the collar part 94. In the present embodiment, the difference (d3−d4: second diameter difference) between the diameter d3 of the opening 96 and the diameter d4 is set to be equal to the first diameter difference. Herein, the second diameter difference can be arbitrarily set. For example, when the second diameter difference is set smaller than the first diameter difference, the horizontal movement of the working tool 52 is restricted by the collar part 94.

As illustrated in FIG. 1, the control unit 14 includes a slider control unit 98 and a fluid supplying control unit 100. The slider control unit 98 controls the driving source 44 to move the slider 40 in a vertical direction. The fluid supplying control unit 100 controls the first fluid supply unit 72 and the second fluid supply unit 74.

Next, a press working method for processing the workpiece using the press working apparatus 10 thus configured will be described by referring to FIG. 1 and FIGS. 5 to 8.

Figure 5:
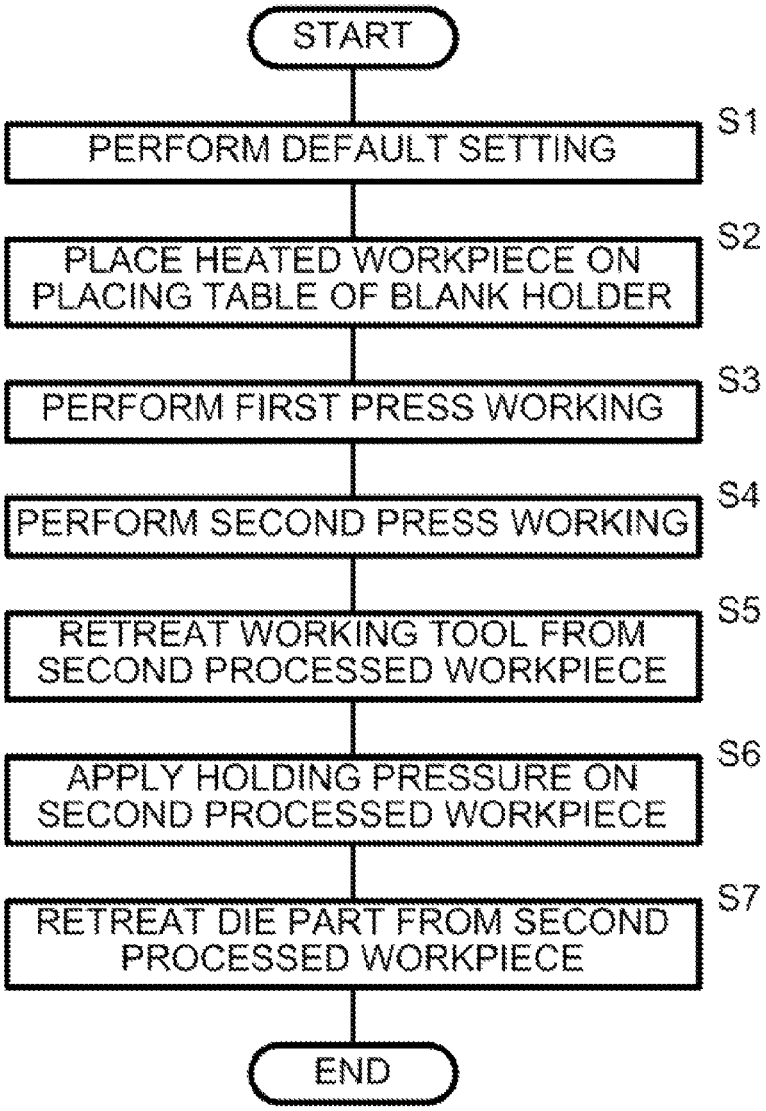
FIG. 5 is a flow chart for explaining a press working method using the press working apparatus illustrated in FIG. 1.
Figure 6:
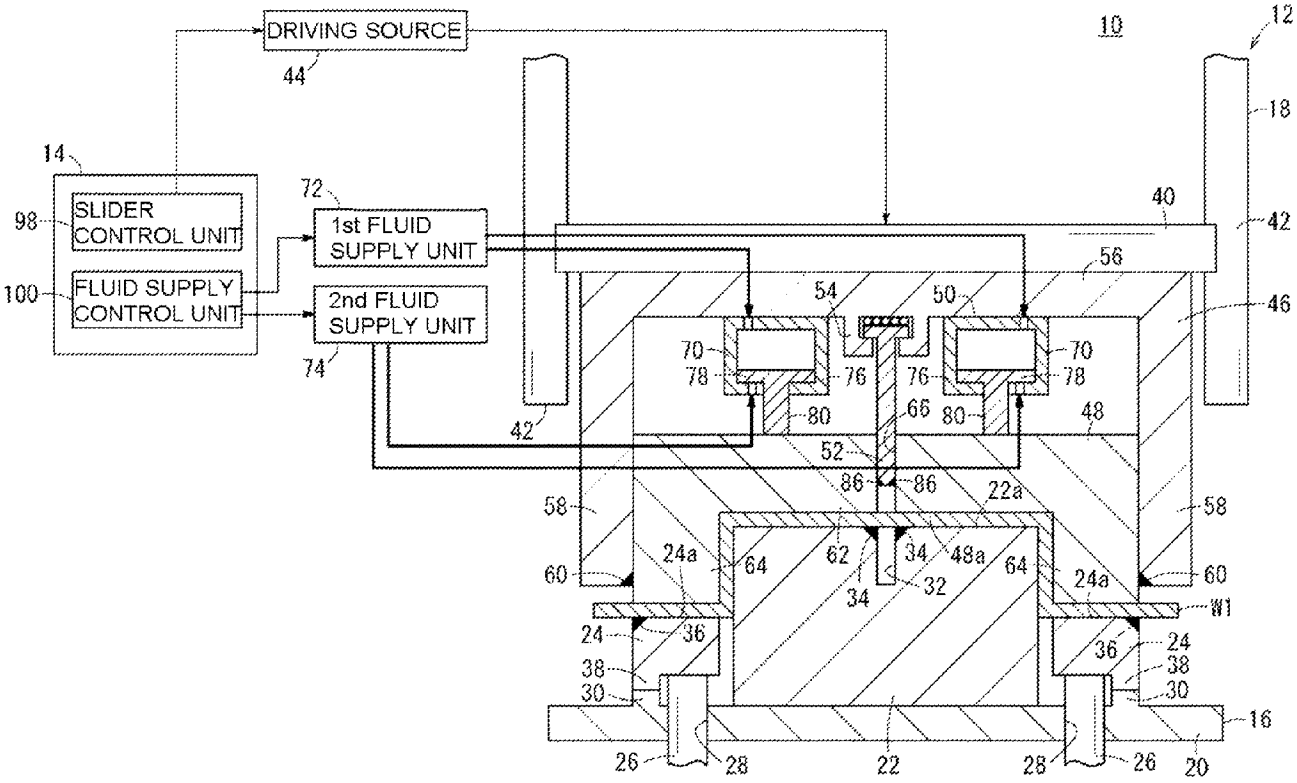
FIG. 6 is a sectional view for explaining the press working apparatus in a state where a first press working is performed.

First, a default setting is performed (Step S1 of FIG. 5). Specifically, the blank holder 24 and the slider 40 are set to an initial position (a state illustrated in FIG. 1) and the fluid supplying control unit 100 controls the first fluid supply unit 72 to allow the pressure in the cylinder main bodies 76, 76 to be higher than a press pressure. Herein, the press pressure refers to a pressing pressure which is applied on the workpiece W during the first press working and can be preset and stored in the control unit 14. Meanwhile, a fluid is not supplied from the second fluid supply unit 74 to the cylinder main bodies 76, 76. However, a fluid having a pressure lower than the press pressure may be supplied from the second fluid supply unit 74 to the cylinder main bodies 76, 76. By doing so, it is possible to reduce a load of the cylinder units 70, 70 due to an own weight of the die part 48.

Subsequently, an unprocessed workpiece W which is heated to a predetermined temperature in the previous process, for example, in a heating furnace is placed on the placing surface 24*a* of the blank holder 24 (Step 2). Herein, the cooling of the workpiece W is stared after the workpiece is taken out from the heating furnace.

And then, the first press working is performed (Step S3). Specifically, the slider control unit 98 drives the driving source 44 to cause the slider 40 to be lowered. As the slider 40 is lowered, the holder portion 64 contacts the upper surface of the workpiece W and the workpiece W is held by the holder portion 64 and the blank holder 24. And then, as the slider 40 is further lowered, the blank holder 24 is lowered by the holder portion 64 and the workpiece W is gradually pressed in a desired shape by the die part 48 and the punching part 22 to form a first processed workpiece W1 (see FIG. 6).

Further, in Step S3, the first processed workpiece W1 is in contact with the punching part 22 and the die part 48. Thereby, a heat of the first processed workpiece W1 is diffused (dissipated) to the punching part 22 and the die part 48 and therefore a cooling speed of the first processed workpiece W1 increases from the time of Step S3. Accordingly, the workpiece W can be quenched by adjusting the material quality of the punching part 22 and/or the die part 48 or the contact area thereof with the workpiece W (the first processed workpiece W1). In this case, a processed product with high strength can be obtained.

Subsequently, the second press working is performed (Step S4). Specifically, the slider control unit 98 drives the driving source 44 to cause the slider to be further lowered, thereby lowering the base part 46 relative to the die part 48. As a result, the punching (piercing) process for punching (piercing) the first processed workpiece W1 is started by the cutting blade 86 of the working tool 52 and the cutting blade 34 of the punching part 22, and excessive portions of the first processed workpiece W1 are cut away by the cutting blade 60 of the extending portion 58 and the cutting blade 36 of the blank holder 24, and thus the second processed workpiece W2 can be formed (see FIG. 7). At this time, the cylinder pressure is set at a pressure sufficient to urge the workpiece W (first processed workpiece W1) during the piercing processing. As necessary, the fluid supplying control unit 100 may control the first fluid supply unit 72 and the second fluid supply unit 74. This is similarly applied to the step S5 and Step S6 which will be described later.

Subsequently, the working tool 52 is retreated from the second processed workpiece W2 (Step S5). Specifically, the slider control unit 98 controls the driving source 44 to raise the slider 40, thereby raising the base part 46 (see FIG. 8).

And then, it is preferred that the slider control unit 98 controls the driving source 44 to cause the second processed workpiece W2 to be subjected to a predetermined holding pressure (Step S6). By doing so, deformation of the second processed workpiece W2 due to a thermal strain can be suppressed.

And, after the temperature of the second processed workpiece W2 reaches a predetermined temperature, the die part 48 is retreated from the second processed workpiece W2 (Step S7). At this step, the press working using the press working apparatus 10 of the present embodiment is completed.

However, in the press working mentioned above, when the first press working is performed, the die part 48 is urged on the heated workpiece W and thus thermally expanded due to a heat of the workpiece W. When the die part 48 is expanded, there is a case that the through hole 66 formed on the die part 48 is displaced in a horizontal direction relative to the fixed portion 56.

Figure 9:
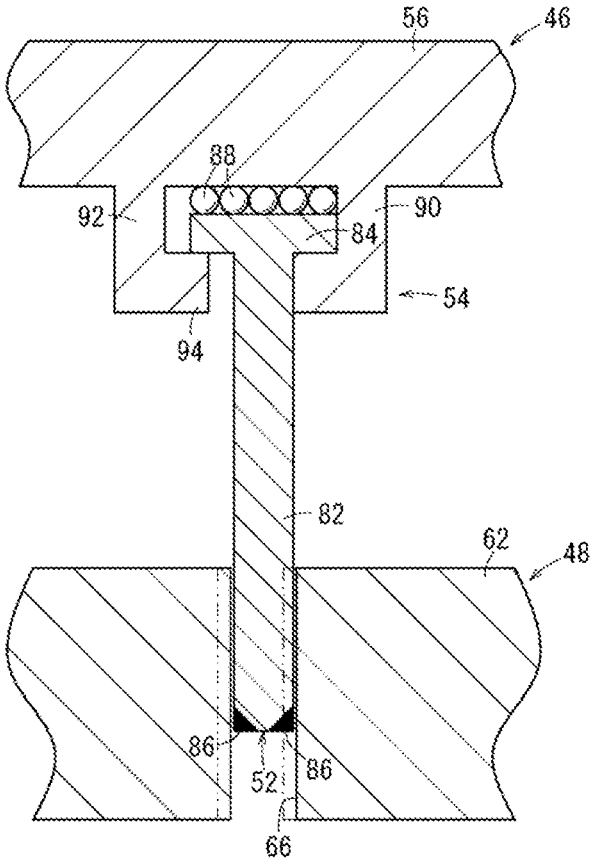
FIG. 9 is a sectional view for explaining the press working apparatus in a state where the working tool is horizontally moved to align with a position of the through hole.

And, as illustrated in FIG. 9, according to the press working apparatus 10 of the present embodiment, the working tool 52 is supported by the support member 54 in a state where the working tool can move in the horizontal direction. Accordingly, when the through hole 66 is displaced in a horizontal direction relative to the fixed portion 56, the working tool 52 is urged by an wall surface of the through hole 66 to move in the horizontal direction. That is, the working tool 52 moves to align with the position of the through hole 66. Thereby, the interference between the working tool 52 and the die part 48 can be avoided and therefore it is possible to suitably prevent the cutting blade 86 of the working tool 52 from being worn or the die part 48 from being damaged. In this way, the first processed workpiece W1 can be securely processed by the working tool 52 with high precision.

Further, in the press working apparatus 10 according to the present embodiment, a plurality of rolling elements 88 . . . 88 may be provided between the lower surface of the flange part 84 and the upper surface of the fixed portion 56 and thus it is possible to smoothly move the working tool 52, as compared to a case of directly contacting the upper surface of the flange part 84 with the lower surface of the fixed portion 56.

Further, since the collar part 94 constituting the housing 90 is in contact with the lower surface of the flange part 84, it is possible to restrict the movement of the working tool 52 in a vertical direction. Thereby, the backlash of the working tool 52 in the vertical direction can be suppressed and therefore the punching processing of the working tool 52 can be securely performed with high precision.

The press working apparatus 10 according to the present embodiment is not limited to the configuration mentioned above. For example, as the biasing mechanism, a driving source (piezo element) other than the cylinder mechanism 50 mentioned above or an elastic member such as a spring member may be used.

The present invention is not limited to the above embodiments but can be variously modified without departing from the spirit of the present invention.

For example, a plurality of rolling elements may be provided between the lower surface of the flange part 84 and the upper surface of the collar part 94. Thereby, it is possible to more smoothly move the working tool 52.

Further, coolant flow path through which a coolant such as a cooling water flows is formed in the blank holder 24 and the punching part 22. In this case, it is possible to further speed up the cooling speed of the workpiece (the first processed workpiece W1, the second processed workpiece W2).

The press working apparatus according to the present invention is not limited to an example where the first mold and the second mold can be approached and separated from each other in a vertical direction. For example, the press working apparatus may be applied to a case where the first mold and the second mold can be approached and separated from each other in a horizontal direction.

In accordance with the above embodiments, a press working apparatus 10 for processing a heated workpiece W may include: a base part 46 which is relatively movable so as to advance and retreat with respect to the workpiece W; a pad 48 provided on the base part 46 and configured to hold the workpiece W; a working tool 52 provided on the base part 46 to pass through the pad 48 and adapted to process the workpiece 48; and a support member 54 configured to movably support the working tool 52 in a direction perpendicular to an advance and retreat direction of the base part 46.

According to this structure, the working tool can be supported movably in a direction perpendicular to the advance and retreat direction of the base part by the support member. Accordingly, when the pad urging the heated workpiece is thermally expanded and thus the through hole of the pad is displaced relative to the base part in a direction perpendicular to the advance and retreat direction of the base part, the working tool can be moved to align with the position of the through hole. Thereby, the interference between the working tool and the pad can be avoided and therefore it is possible to suitably prevent the cutting blade of the working tool from being worn or the pad from being damaged. In this way, the workpiece can be securely processed by the working tool with high precision.

In the above structure, the support member 54 may include a rolling element 88 provided between a rear end surface of the working tool 52 and a surface of the base part 44.

By this structure, it is possible to more smoothly move the working tool, as compared to a case of directly contacting the end surface of the working tool with the surface of the base part.

In the above structure, the support member 54 may include a housing 90 fixed to the base part 46 to restrict a movement of the working tool 52 relative to the base part 46 in said advance and retreat direction and configured to surround a rear end side of the working tool 52 and accommodate the rolling element 88.

By this structure, it is possible to prevent a rattle of the working tool in the advance and retreat direction of the base part. Thereby, the workpiece can be securely processed by the working tool with higher precision.

According to the press working apparatus of the above embodiments, since the working tool can be supported movably in a direction perpendicular to the advance and retreat direction of the base part by the support member, the interference between the working tool and the pad can be avoided and therefore it is possible to suitably prevent the cutting blade of the working tool from being worn or the pad from being damaged. Accordingly, the workpiece can be more securely processed by the working tool with high precision.

What is claimed is:

1. A press working apparatus for processing a heated workpiece, the apparatus comprising:

a base part which is relatively movable so as to advance and retreat with respect to the workpiece;

a pad provided on the base part and configured to hold the workpiece;

a working tool provided on the base part to pass through the pad and adapted to process the workpiece; and a support member provided on the base part and configured to movably support the working tool so that the working tool is movable relative to the base part and the support member in a direction perpendicular to an advance and retreat direction of the base part, wherein a through hole is defined through the pad, and the working tool passes through the through hole and is configured to be movable in the direction perpendicular to the advance and retreat direction of the base part by displacing a wall surface of the pad that defines the through hole.

2. The apparatus according to claim 1, wherein the support member includes a rolling element provided between a rear end surface of the working tool and a surface of the base part.

3. The apparatus according to claim 2, wherein the support member includes a housing fixed to the base part to restrict a movement of the working tool relative to the base part in said advance and retreat direction and configured to surround a rear end side of the working tool and accommodate the rolling element.

* * * * *